US005243388A

United States Patent [19]

Berns et al.

[11] Patent Number: 5,243,388

[45] Date of Patent: Sep. 7, 1993

[54] SYSTEM FOR CLEANING THE DEVELOPER UNIT IN AN ELECTRONIC REPROGRAPHIC PRINTING SYSTEM

[75] Inventors: Robert A. Berns, Rochester; Frank R. Walsh, Webster; Kenneth J. Weaver, Fairport, all of N.Y.; Michael E. Minadeo, Concord, Calif.

[73] Assignee: Xerox Corporation, Stamford, Conn.

[21] Appl. No.: 755,416

[22] Filed: Sep. 5, 1991

[51] Int. Cl.[5] ..... G03G 15/06

[52] U.S. Cl. ..... 355/245; 355/251

[58] Field of Search ..... 355/296, 297, 298, 245, 355/260, 264, 269, 270, 251; 15/256.51, 256.52; 118/652

[56] References Cited

U.S. PATENT DOCUMENTS 3,697,163 10/1972 Jordan ..... 355/212
3,815,380 6/1974 Esmay ..... 64/4
4,522,487 6/1985 Misaua ..... 355/15
4,845,523 7/1989 Miyaji ..... 355/260 X
4,945,956 8/1990 Bueyuekgueclue et al. ... 355/260 X
5,103,730 4/1992 Sarda ..... 15/256.51 X

*Primary Examiner*—Leo P. Picard
*Assistant Examiner*—Christopher Horgan
*Attorney, Agent, or Firm*—Kenyon & Kenyon

[57] ABSTRACT

A method and apparatus for cleaning and replenishing the developer unit of an electronic reprographic printing system. The developer units are mounted in a retractable drawer within the machine. A cover is placed over the developer unit, which is provided with an air inlet and an air outlet. A vacuum machine is connected to the air outlet to create a wind flow within the developer unit for cleaning the unit. A tool is provided for turning the auger within the developer unit when it is being cleaned, and to similarly assist in the subsequent recharging of the developer unit with developer.

16 Claims, 8 Drawing Sheets

SYSTEM FOR CLEANING THE DEVELOPER UNIT IN AN ELECTRONIC REPROGRAPHIC PRINTING SYSTEM

BACKGROUND OF THE INVENTION

The invention relates generally to an electronic reprographic printing system, and more particularly concerns a method and apparatus for cleaning the developer units of a color or black and white reprographic printing system and providing for their replenishment with developer.

The marking engine of an electronic reprographic printing system is frequently an electrophotographic printing machine. In an electrophotographic printing machine, a photoconductive member (typically in the form of a belt) is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member is developed by bringing toner into contact therewith. The toner is supplied to the photoconductive member by a developer unit of the magnet roll or brush type. This forms a toner image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto and requires its own developer unit. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet, creating a color copy.

Regardless of whether color or only monochromatic reproduction is achieved, the developer units employed are often of the magnet roll type, and are described in further detail in U.S. Pat. No. 4,377,334 to Nishikawa, 4,583,112 to Morano et al., and 4,800,411 to Tanaka et al. The contents of each of these three patents is hereby incorporated by reference. Magnet roll developer units use auger or other mixing structure to combine toner with a triboelectrically active carrier to which the toner adheres to produce developer. The developer is enveloped by lines of magnetic force generated by a magnet roll within the developer unit to form a brush-like structure which is swept across the copy material (usually paper). The toner component of the developer is then adhered to the copy; the carrier material is returned to the developer unit for re-use.

After a number of copies, the carrier loses its potency and must be replaced. One way of replacing the carrier involves manually removing the developer unit and relying on gravity and manual mechanical agitation to remove the developer (carrier and commingled toner) from the developer unit. This process is excessively time consuming, even for black and white machines where only one developer unit is present, and can take upwards of 18–20 minutes per developer unit. In a color machine, where four such units are present, the total time required to clean all of the units represents a significant expenditure in machine down-time and labor. There remains a need for a way to clean the developer units with far less down time and greater ease.

SUMMARY OF THE INVENTION

The invention satisfies this need by providing a system by which a vacuum device can be used to quickly clean the developer unit. A curved plastic housing is fitted over the upper exposed portion of a developer unit equipped with air inlet and outlet ports. A vacuum creating device is connected to the air outlet by a nozzle. When activated, the vacuum draws in air from the inlet, which creates a turbulent air flow within the developer unit which helps cleanse the device of developer. The invention utilizes a tool to link the developer units to the drive mechanism inside the machine so that the augers and magnet rolls in the developer housings may be selectively rotated when the drawer containing the developer units is retracted away from the housing. The vacuum system includes an electrical ground with respect the developer units to avoid electrical shock.

The invention has the advantage that it can be used to be used to clean a developer unit in relatively little time, and does not require the removal of the developer unit from the machine.

DETAILED DESCRIPTION

Figure 1:
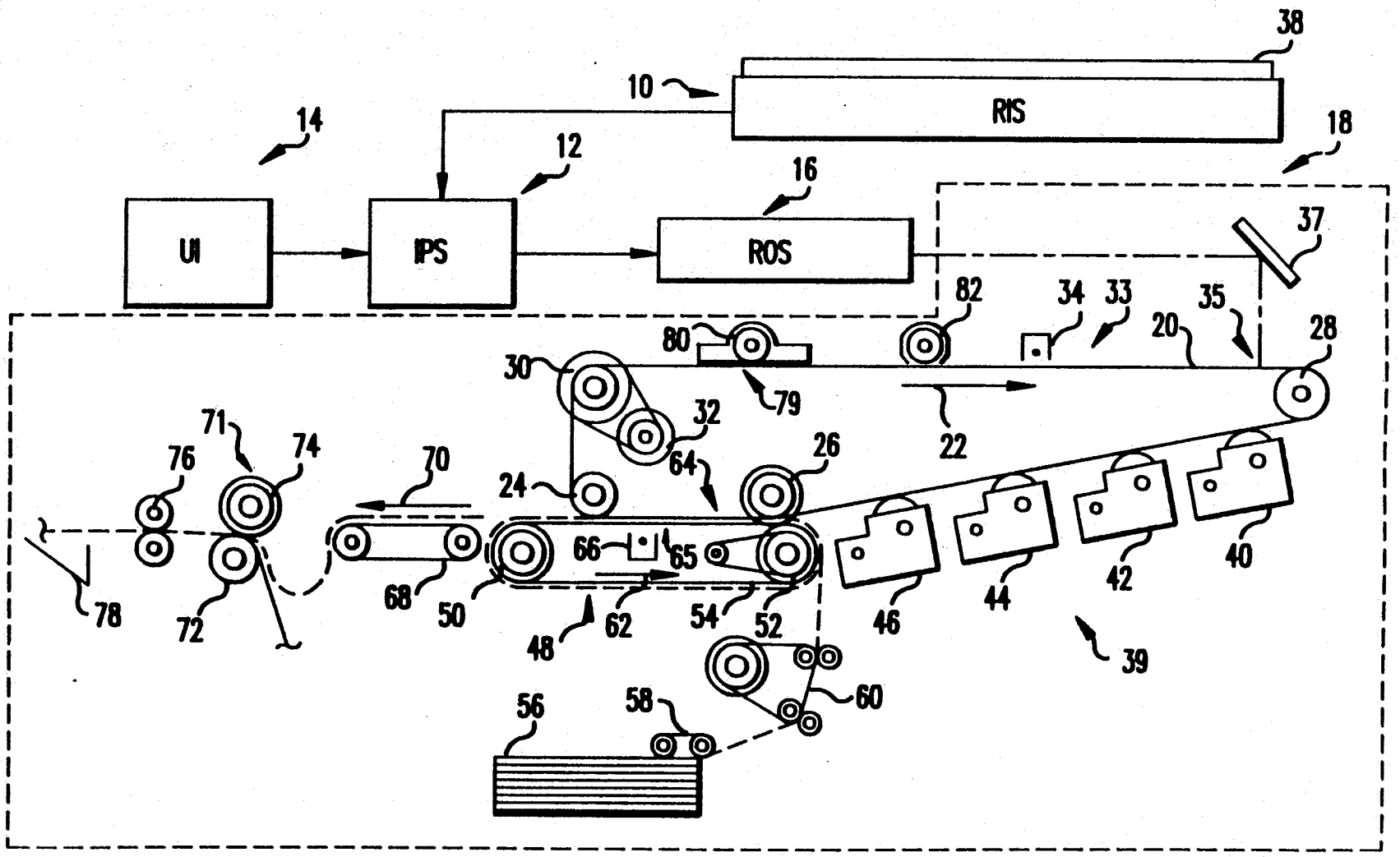
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD) array. The RIS captures the entire original document and converts it to a series of raster scan lines and measures a set of primary color densities, i.e. red, green, and blue densities, at each point of the original document. This information is transmitted to an image processing system (IPS), indicated generally by the reference numeral 12. IPS 12 contains control electronics that prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser and an associated rotating polygon mirror block. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines, which are transmitted as electrical signals to IPS 12. The electrical signals from RIS 10 correspond to the red, green, and blue densities at each point in the original document. IPS 12 converts the set of red, green, and blue density signals, i.e., the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic roll or brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44, and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

Figure 2:
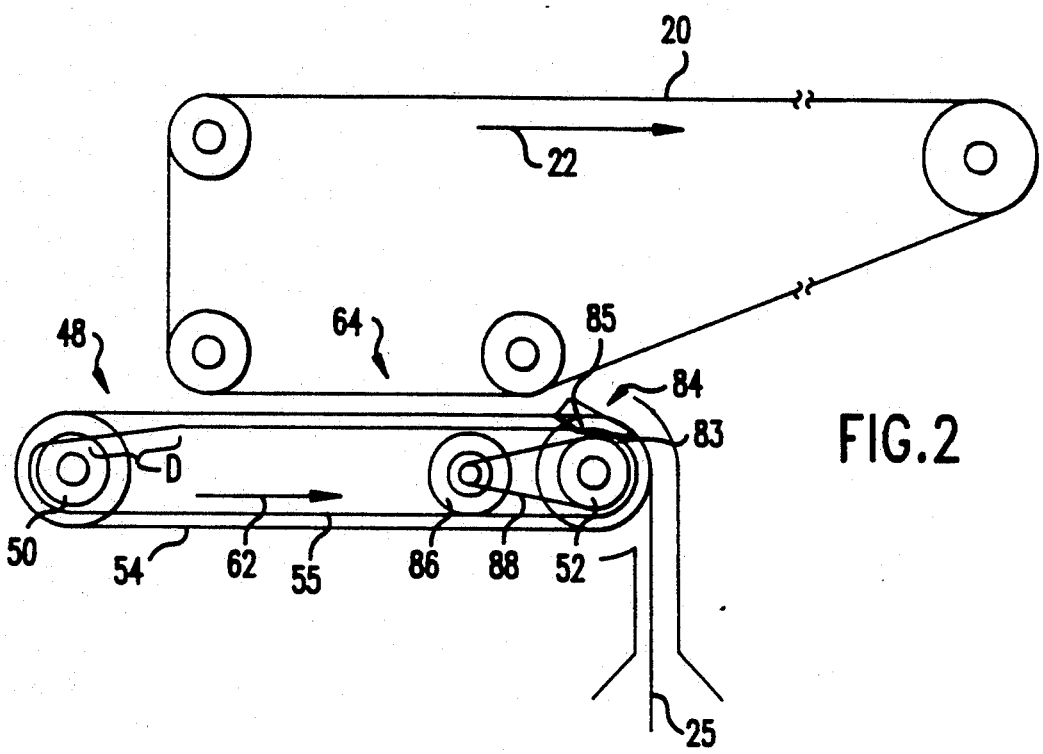
FIG. 2 is a schematic elevational view showing further details of the sheet transport system used in the electrophotographic printing machine of FIG. 1 and also showing the sheet gripper of the sheet transport system at a position prior to entering the transfer zone.
Figure 3:
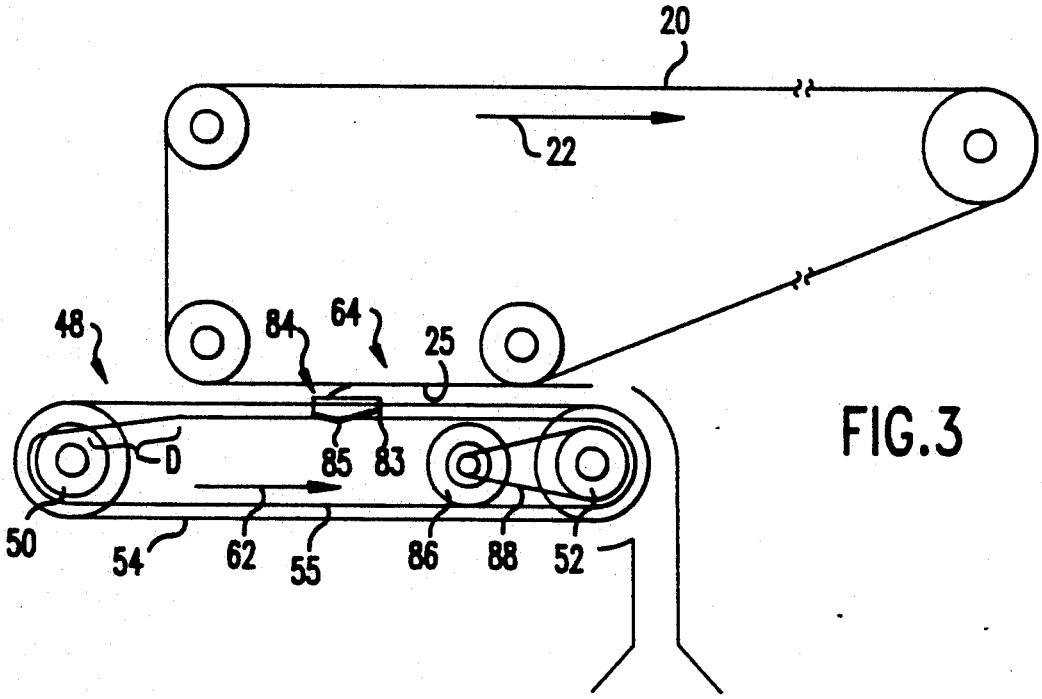
FIG. 3 is a schematic elevational view showing further details of the sheet transport system used in the electrophotographic printing machine of FIG. 1 and also showing the sheet gripper of the sheet transport system at a position within the transfer zone.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper or transparent plastic. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper, generally indicated by the reference numeral 84 (see FIGS. 2-3), extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. Further details of the sheet transport apparatus will be discussed hereinafter with reference to FIGS. 2-3. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

In the discussion that follows, the back of the machine is generally referred to as the inboard side; the front (i.e., the side nearer the machine operator) is referred to as the outboard side.

Figure 4:
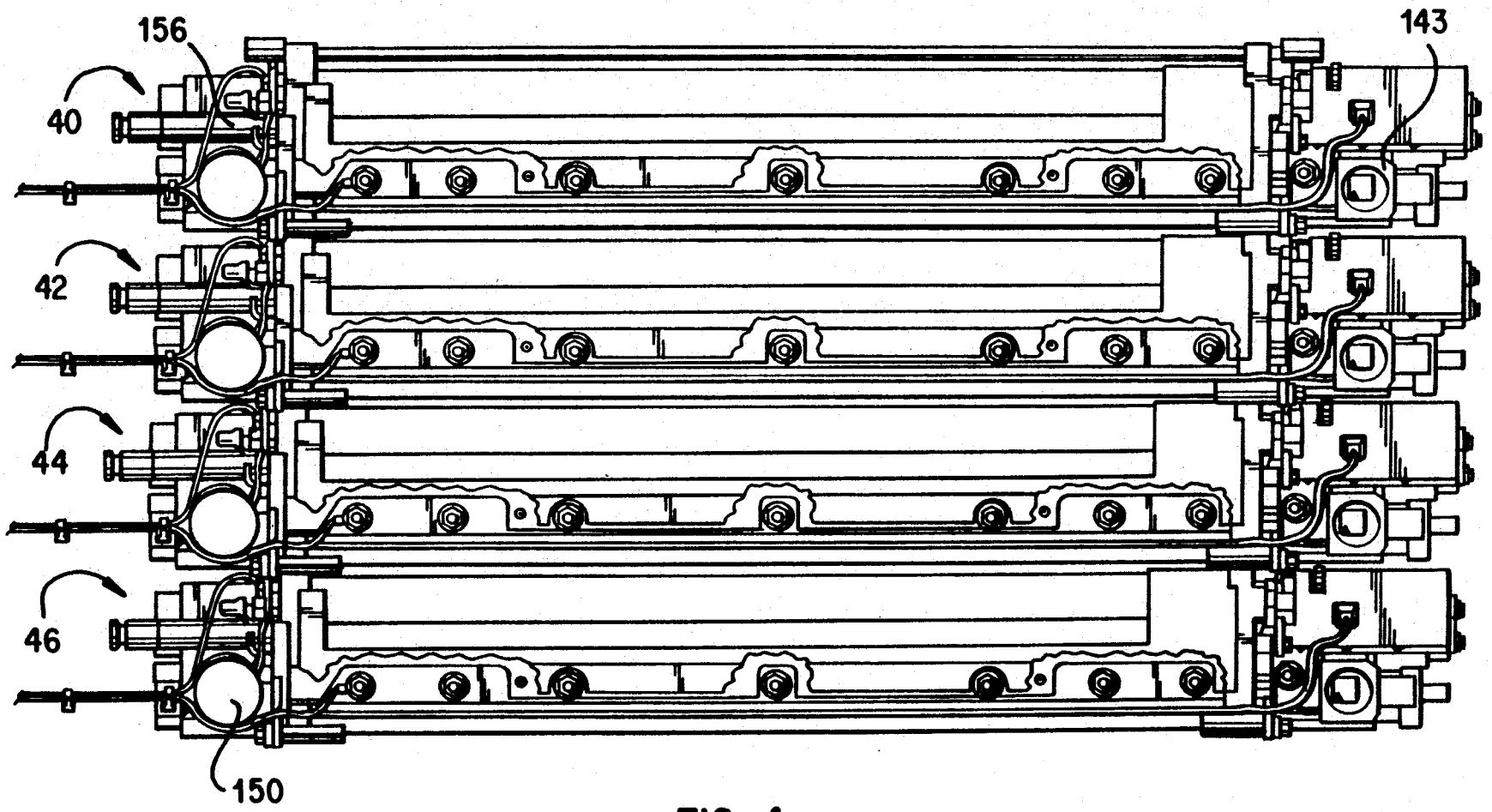
FIG. 4 is a top plan view of four developer units as they may be grouped together in an electrophotographic printing machine.
Figure 5:
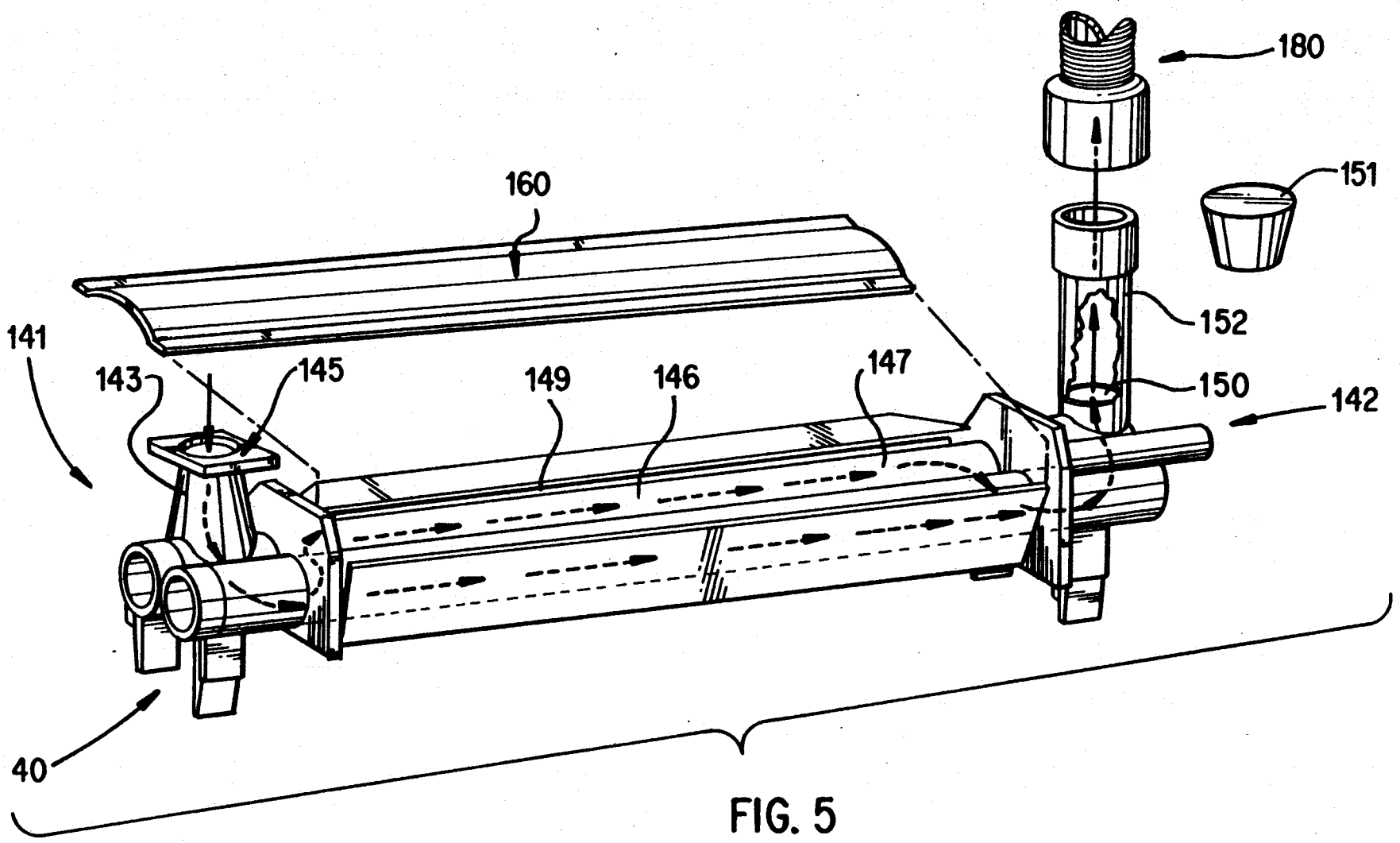
FIG. 5 is an isometric exploded view of a developer unit and associated vacuum cleaning structures.

The construction of the reprographic system is generally modular for ease of maintenance. In particular, the four developer units are grouped together (FIG. 4) beneath the lower surface of the photoconductive belt 20 in a retractable module drawer 100, which is connected by rails (not shown) to the main body of the machine. FIG. 5 shows a perspective view of one such developer unit 40 and associated vacuum cleaning structure. At the inboard side 141 of each developer module is a toner stack 143 through which passes toner by means of a shutter assembly 145 when the developer housings are in their fully inserted position. When the machine is in use, the shutter cooperates with an overlying toner hopper (not shown) to provide the developer module with a supply of toner. As is conventional in this art, the toner is gravity fed into the developer unit 40 where it is mixed by means of augers or other mechanical mixing means with the carrier material to form developer. The outboard side 142 of the developer unit is provided with a selectively sealable outboard port 150, which is ordinarily sealed during electrostatic reproduction. The outboard and inboard side of the developer are traversed by a magnet roll 147 and possibly the auger structure, as is conventional in the art. The general shape of the developer housing is determined by a metallic extrusion 149 surrounding the auger and magnet roll. This extrusion has a generally rectangular elongated opening 146 along its upper surface through which a whisker-like brush of developer may project and sweep across the copy material.

Figure 6:
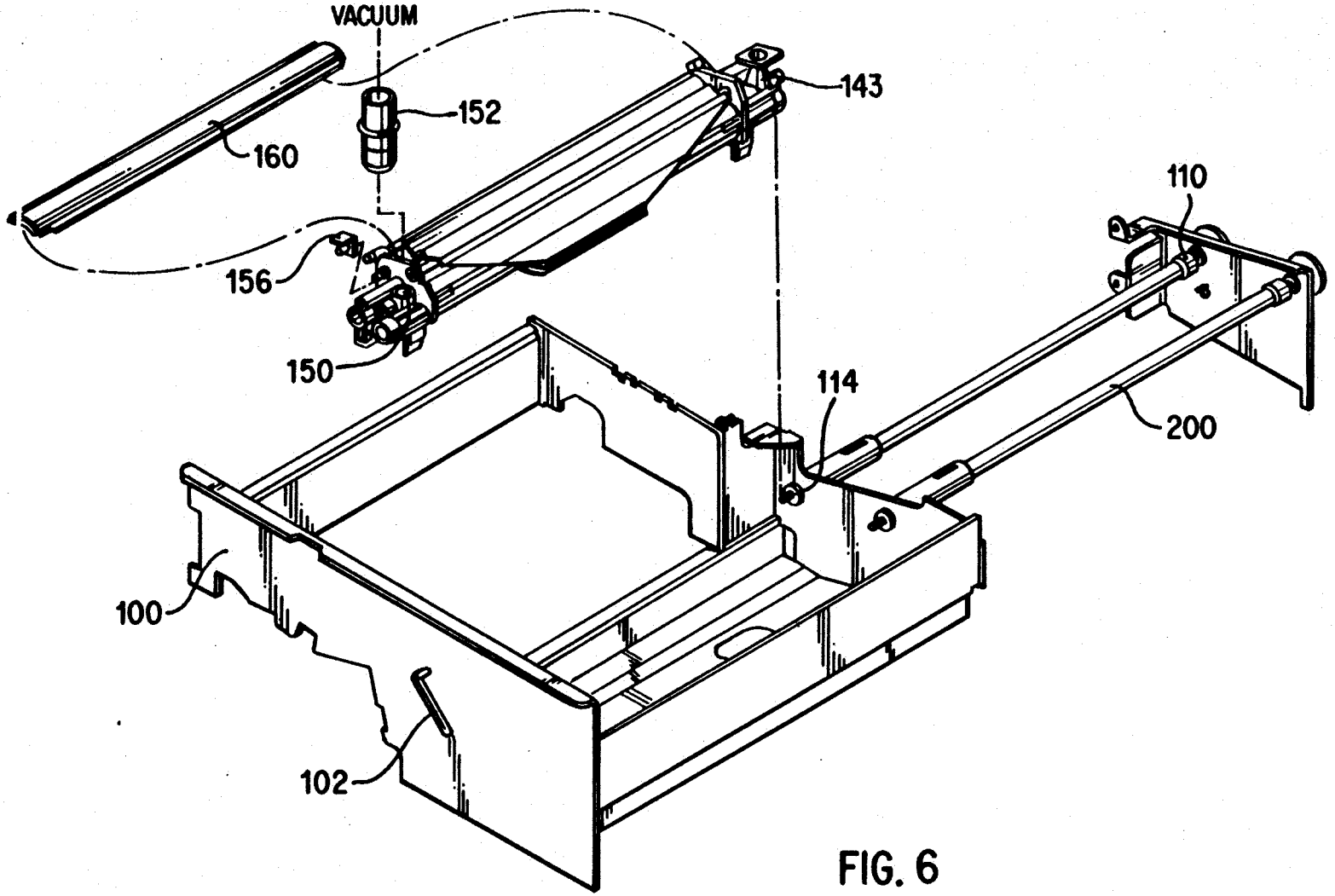
FIG. 6 is an isometric view similar to that of FIG. 5, further showing the relationship between an exemplary developer unit, drive shaft extender, and main drive.

When one wishes to clean a developer unit in a color reprographic system, the drawer containing the four developer units (one in the case of a monochrome machine) is retracted away from the machine by pulling a module drawer handle 102 or other suitable means. This retraction serves to disconnect each of the developer units both from its respective toner supply, as well as from the main developer unit drive. (The main drive is represented schematically by 110 in FIG. 6.) At this point, the toner stack 143 is exposed to the atmosphere. A developer housing cover (160 of FIG. 5) is then placed in sealing arrangement over the opening 146 of a given developer unit. This developer housing cover 160 is further shown in FIGS. 7 and 8, and has the form of a section of a cylindrical surface 161 whose edges terminate in generally flat, rectangular portions 162 and 164. The developer housing cover is arcuate in transverse section (FIG. 8), and configured so as to provide sufficient clearance (approximately 8 mm) with respect to the underlying magnet roll without creating an excessively large space thereunder. The cover is provided with foam or other suitable sealing element 165 at its inboard and outboard ends for providing an enhanced seal of the cover with respect to the developer unit housing. The Cover 160 is preferably made of a transparent, high density plastic to allow for the visual inspection of the underlying developer unit during cleaning.

The outboard end of the developer unit is equipped with a selectively sealable outboard nozzle port 150. It is important that this port be closed during copying so as to prevent the unwanted expulsion of developer from the port during reproduction. When the developer unit is to be cleaned, this port may be exposed by removing a plug 151 or other replaceable mechanical seal from the port. Hence, the developer unit is seen to have both a port of pneumatic ingress (via the toner stack and shutter assembly) and a port of pneumatic egress (via the vacuum nozzle), with the remainder sealed off from the atmosphere by the developer housing cover.

Figure 7:
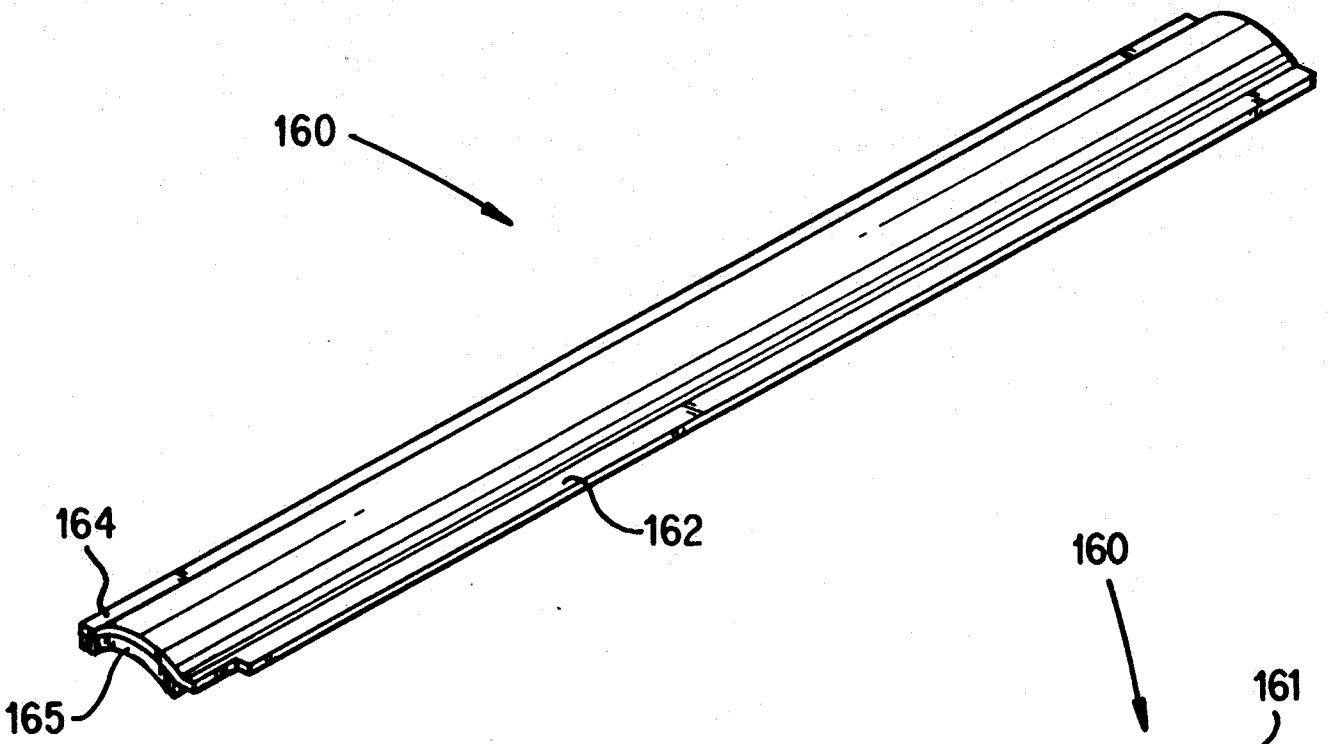
FIG. 7 is a perspective view of the developer housing cover.
Figure 8:
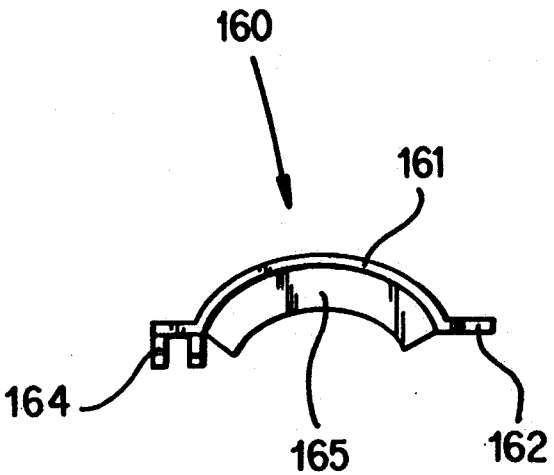
FIG. 8 is a cross-sectional view of one embodiment of the developer housing cover of FIG. 7.

FIGS. 7 and 8 show the developer housing cover in greater detail. The curved cylindrical portion of the developer housing cover terminates in two generally flat portions 162 and 164, one of which may define a lip configured to mate with the knife edge of the developer unit extrusion and the other of which may define a longitudinal edge for fitting into the other side of the developer unit extrusion. It should be clear to those of ordinary skill in the art that the particular configuration of the sealing structure provided the developer housing cover is a function of the specific geometry of the developer housing employed with which is must mate.

A vacuum nozzle tool 152 is provided for insertion into the outboard port of the developing unit. A vacuum creating device 180 is then connected to the vacuum nozzle. One example of a suitable vacuum device is the "Laser Vac" tool produced by the Eltrex Company of New York State. This vacuum tool is characterized by the use of an electrically grounded vacuum hose.

Figure 10:
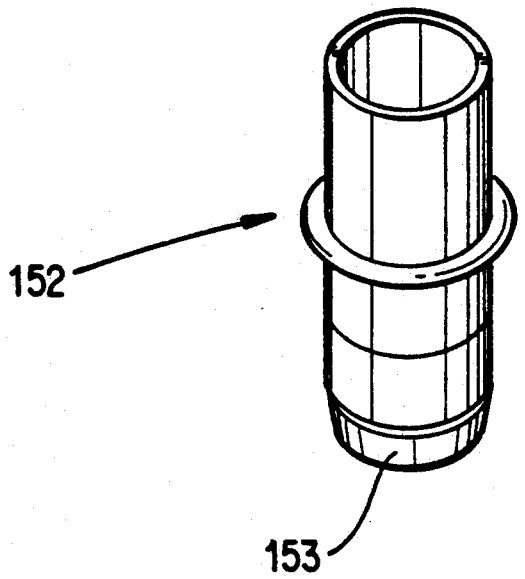
FIG. 10 is an isometric view of a nozzle for use with the vacuum cleaning system.

The rotation of the magnet roll unit and the concomitant movement of the carrier and toner can create a potent electrical charge that can be stored in the developer housing in much the same way that a capacitor can store a large electrical charge. Therefore, in order to minimize the risk of electrical shock to the maintenance technician cleaning the unit, the vacuum device 180 must be grounded to the developer housing 149 so as to discharge any stored electrical energy. This is accomplished by means of the vacuum nozzle, which provides an electrical path from the developer unit to the vacuum device. FIG. 10 shows a perspective view of the nozzle 152 employed. The nozzle is made of metal, and terminates at its lower end in a scratch-safe electrically conductive plastic annulus 153. When inserted, the nozzle is in electrical contact with a developer housing grounding bracket 156 that is electrically linked to the interior of the developer unit. The nozzle is thus able to communicate electrical charge to the electrical conductor-containing hose of the vacuum device, each of which cooperate to complete the grounding circuit. This enables one to safely discharge stored electrical energy.

The retraction of the drawer containing the developer units decouples these units from a necessary portion of their mechanical drive mechanisms. During cleaning, it is desired to have the auger and magnet roll of the developer unit that is being cleaned rotate as they would in the course of normal operation. This serves to agitate the material within the developer unit housing which helps expedite cleaning. Therefore, it is necessary to provide a drive shaft extender 200 (see FIGS. 6 and 9) to reestablish a drive link between the gearing of the developer units and the main drive structure 110 inside the machine. The technician may then direct the machine to begin driving the appropriate unit.

Figure 9:
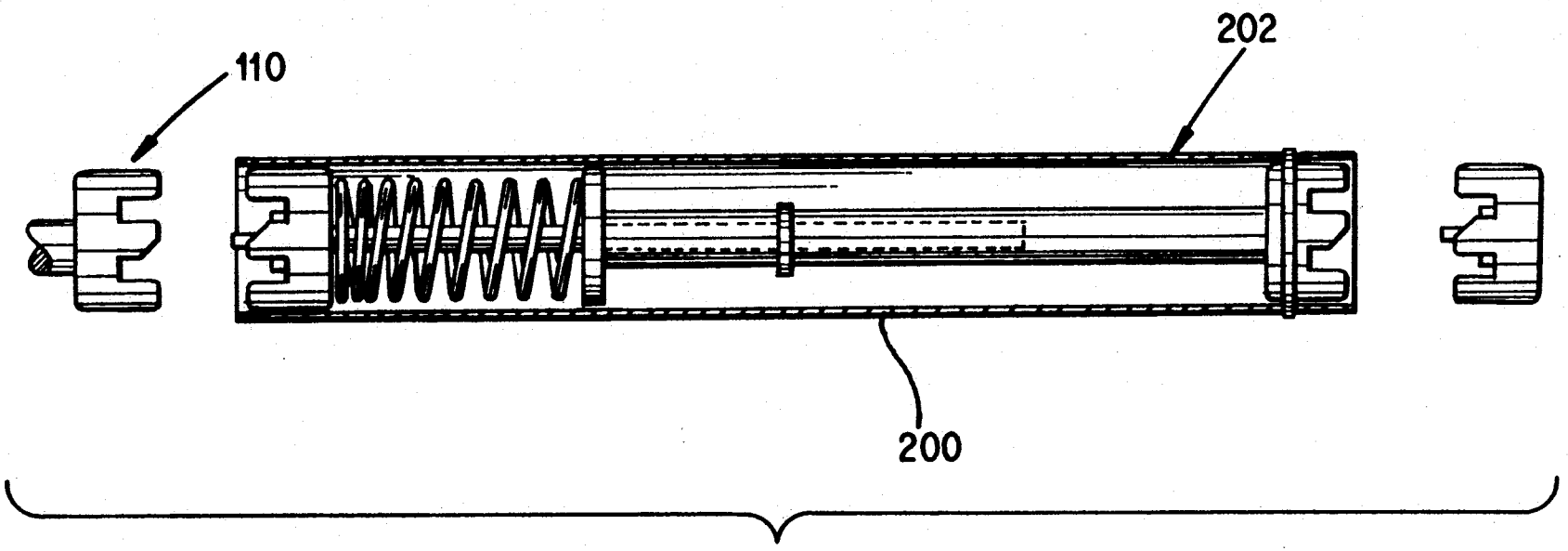
FIG. 9 is a partial sectional view showing a drive shaft extender tool.

FIG. 9 illustrates the developer drive extension shaft. This tool is made of an extruded aluminum or plastic hollow tube 202 having a toothed coupling interface at either end. One or both of these interfaces may optionally be connected to a transverse spring loaded rod, which allows for the compression of the interfaces with respect to one another to facilitate insertion and removal of the drive tool. The particular configuration of the coupling at either end will be determined by the particular gearing employed in the reprographic machine. Typically, the drive extender shaft can be used either in conjunction with the auger of the one black developer unit alone, or to simultaneously drive the augers of the three color developer units. The motion of the magnet roll would typically be accomplished by energizing a magnetic clutch corresponding to the unit to be cleaned via the reprographic machine's control panel. Consequently, even when all of the augers on the three color developer units are in motion, in only one of these units is there developer motion of the sort which might blow developer out of the openings at the tops of the developer units not sealed off with a developer housing cover. This grouping of developer unit drive structure is motivated by the faster mag roll speed employed by the developer container black developer relative to the slower speed required of the three color units. The coupling shaft may be configured with a spring bias so that it can quickly be moved between the color drives and the black developer drive. When not in use, the drive shaft extender can be stored within the reprographic machine.

Once the developer housing cover, vacuum nozzle, and vacuum device are in place, the drive shaft extender tool can be used to couple the appropriate drive to the appropriate group of developer housings and the process of cleaning the developer housing can begin. (Alternatively, the drive shaft extender tool can be put in place before attaching the vacuum device.) The developer unit augers of the monochromatic or grouped color developer units and the magnet roll of the particular developer unit to be cleaned are activated by appropriate command to the control panel of the machine. This commences the agitation of the contents of the developer unit. The vacuum device causes air to be sucked into the developer unit housing by way of the toner stack in a turbulent, cyclonic fashion through the unit and out the nozzle port. The wind flow has been observed to clean a developer unit containing 800 grams of developer material in as few as two minutes.

When the unit is judged to be clean (this may be seen by looking through the transparent housing cover), one may utilize the system of the invention to recharge the developer unit with developer. The nozzle and vacuum device are removed and replaced with a prepackaged container of developer. This developer is fed to the developer unit through nozzle port 150. Concomitantly, the augers of the developer housing are set in rotation to spread the developer throughout the developer unit housing. The process of replenishment may take approximately two minutes, depending upon the amount of developer being fed into the system. After the developer unit has been charged with developer, the magnet roll is briefly activated to create an initial brush of developer. The housing cover is left on the during replenishment so that in the brief period in which the magnet roll is activated, developer does not spray out of the housing.

After the cleansing and replenishment operations have been completed, the nozzle port 150 has again been sealed off, and the housing cover removed, the process may be repeated for other developer units. This procedure may then be repeated for the other developer units. When the process is complete, the drive shaft extender is removed, and the developer units are returned to their operating positions.

It is also within the scope of the invention to provide a plurality of developer unit housing covers to enable one to simultaneously clean a plurality of developer units. In this case, each unit may be connected to its own independent vacuum source, or a single vacuum source connected to each of the developer units by the appropriate pneumatic connections.

While the invention has been described with reference to a specific embodiment, it will be apparent to those skilled in the art that many alternatives, modifications, and variations may be made. Accordingly, it is intended to embrace all such alternatives, modifications that may fall within the spirit and scope of the appended claims.

What is claimed is:

1. A system for removing toner and carrier particles from a developer unit, comprising:

a housing having a first end and a second end, a top portion and a bottom portion, and an opening in the top portion substantially traversing said top surface of said housing, said opening in said top surface being sufficiently large to allow for the effective passage of developer particles out of the developer housing;

an inlet situated near said first end and a selectively sealable outlet situated near said second end of said housing; and a housing cover configured to mate with the housing so as to substantially seal off said opening in said top portion of said housing.

2. The apparatus of claim 1, further comprising means for establishing an electrical path between the interior of said housing and a point on the exterior of said housing adjacent the outlet.

3. The apparatus of claim 1, further comprising an electrically conductive nozzle configured for attachment to said outlet.

4. The apparatus of claim 1, further comprising a vacuum means configured for attachment to said housing.

5. The apparatus of claim 4, wherein the vacuum means is attached to the outlet.

6. The apparatus of claim 4, wherein the vacuum means includes a hose that provides a path for an electrical ground, and further includes a nozzle having an electrically conductive path configured for attachment both to the housing and to the vacuum means.

7. The apparatus of claim 1, wherein the housing cover has a curved section.

8. The apparatus of claim 7, wherein the housing cover is provided with sealing means.

9. The apparatus of claim 1, wherein the housing cover is made of a clear material.

10. A method for cleaning the developer unit of an electronic reprographic printing system, comprising the steps of:

moving the developer unit to a position where it can readily be accessed;

providing for an opening between a first end of the developer unit and the atmosphere;

providing a sealable nozzle opening to a second end of the developer unit;

providing a housing cover for sealing off any broadly exposed areas of the developer unit against the atmosphere;

attaching a vacuum means to the opening at the second end of the developer unit; and using the vacuum means to create a wind that flows from the opening at the first end, through the developer unit and hose to the vacuum means.

11. The method of claim 10, further comprising the step of rotating an auger within the developer unit.

12. The method of claim 10, wherein the developer unit has a generally rectangular opening on an upper surface, and a developer housing cover is placed over this opening.

13. The method of claim 10, wherein a plurality of developer units is cleaned simultaneously by the use of a vacuum means attached to a plurality of developer units, each of which is provided with a housing cover.

14. A method for cleaning the developer unit of an electronic reprographic printing system, comprising the steps of:

moving the developer unit to a position where it can readily be accessed;

providing for an opening between a first end of the developer unit and the atmosphere;

providing a sealable nozzle opening to a second end of the developer unit;

providing a housing cover for sealing off any broadly exposed areas of the developer unit against the atmosphere;

attaching a vacuum means to the opening at the second end of the developer unit;

using the vacuum means to create a wind that flows from the opening at the first end, through the developer unit and hose to the vacuum means, and providing an electrical ground for discharging electrical energy. from the developer housing.

15. The method of claim 10, further including the step of providing means for turning an auger and magnet roll in the developer unit when the developer unit is retracted from the reprographic machine.

16. The method of claim 15, further including the steps of:

detaching the vacuum and nozzle from the nozzle opening;

feeding a predetermined quantity of developer to the developer unit through said nozzle opening;

removing the housing cover;

sealing the nozzle opening; and returning the developer unit to its operating position.

* * * * *